US005839345A

United States Patent [19]

Sandau et al.

[11] Patent Number: 5,839,345

[45] Date of Patent: Nov. 24, 1998

[54] HYDRAULIC CONTROL IN MONOBLOCK STRUCTURE FOR LIFTING AND LOWERING A LOAD WITH AT LEAST TWO ELECTROMAGNETICALLY ACTUATABLE PROPORTIONAL DISTRIBUTING VALVE ELEMENTS

[75] Inventors: Hartmut Sandau, deceased, late of Schwieberdingen, by Roswitha Sandau and Christine Sandau, legal representatives; Werner Schumacher, Asperg; Rainer Trucksess; Holger Lueues, both of Vaihingen/Enz, all of Germany

[73] Assignee: Robert Bosch GmbH, Stuttgart, Germany

[21] Appl. No.: 880,967

[22] Filed: Jun. 23, 1997

[30] Foreign Application Priority Data

Dec. 23, 1994 [DE] Germany ..... 44 46 145.3

[51] Int. Cl.[6] ..... F15B 11/08; F15B 13/044

[52] U.S. Cl. ..... 91/457; 91/459

[58] Field of Search ..... 91/454, 457, 459

[56] References Cited

U.S. PATENT DOCUMENTS

| | | | |
|---|---|---|---|
| 4,362,018 | 12/1982 | Torii | 91/457 X |
| 4,611,528 | 9/1986 | Nanda et al. | 91/457 X |
| 5,072,648 | 12/1991 | Krahn et al. | 91/454 X |
| 5,372,060 | 12/1994 | Maruyama et al. | 91/454 X |
| 5,374,794 | 12/1994 | Holmes | 91/454 X |
| 5,522,479 | 6/1996 | Jo | 91/454 X |

*Primary Examiner*—Hoang Nguyen
*Attorney, Agent, or Firm*—Michael J. Striker

[57] ABSTRACT

A hydraulic circuit in a monoblock structure for lifting and lowering a load has at least two electromagnetically actuatable proportional distributing valve elements, a check valve, a pressure balance for load-independent lifting of the load as an input element, a housing accommodating at least some of the elements and having at least one pump connection, at least one consumer connection, and at least one return connection, the proportional distributing valve elements being disposed parallel to one another, electromagnetic drives seated side-by-side on a same side and at a same height, the pressure balance having a piston which is disposed coaxially next to a longitudinal slide of a first one of the proportional distributing valve elements in a bore that guides and supports both the valve elements, the longitudinal slide of the first proportional distributing valve elements being spring-loaded, and at least one component for adjusting a prestressing and bracing of a spring on the housing of a control penetrating the piston of the pressure balance.

14 Claims, 7 Drawing Sheets

HYDRAULIC CONTROL IN MONOBLOCK STRUCTURE FOR LIFTING AND LOWERING A LOAD WITH AT LEAST TWO ELECTROMAGNETICALLY ACTUATABLE PROPORTIONAL DISTRIBUTING VALVE ELEMENTS

BACKGROUND OF THE INVENTION

PRIOR ART

The invention is based on a hydraulic control in monoblock structure for lifting and lowering a load with at least two electromagnetically actuatable proportional distributing valve elements, a check valve and a pressure balance for load-independent lifting of the load as an input element, at least some of the elements being disposed in a housing that has at least one pump connection, at least one consumer connection, and at least one return connection.

As a rule, in hydraulic controls of monoblock design, the drives, actuating elements and connections are disposed on nearly all the sides of the monoblock housing. Once the drives, connections and adjusting devices for the valve springs have been mounted, controls with large outer dimensions result despite the compact design, since especially the drives are often opposite one another or, being disposed at corners, protrude from the housing. Moreover, such controls usually have long hydraulic conduits of complicated forms, which additionally throttle the flow of pressure fluid through the housing and thus impair the dynamics of the control. Moreover, in a compact design, adjusting the proportional distributing valve elements is difficult, if it can even be done at all.

SUMMARY OF THE INVENTION

The hydraulic control according to the invention, in terms of its housing dimensions and the overall size of the monoblock, makes a small structural volume possible. The individual valve elements are closed together and communicate with one another via short bores or conduits.

The movable valve elements are seated in bores that are constructed and arranged in a way that is favorable from a production standpoint, making it possible to save weight and machining time. To that end, all the valve parts are accommodated in only three bores. A proportional distributing valve element for lifting a load is seated next to a pump connection in the one bore. The bore in which the piston of the pressure balance is coaxially next to the longitudinal slide of the proportional distributing valve element is a through bore without any graduation whatever. A restoring spring is seated between the piston and the longitudinal slide and acts upon the longitudinal slide. To enable bracing the restoring spring relative to the housing in a space-saving way, at least one component for bracing and adjusting its prestressing is passed through the piston of the pressure balance.

A proportional distributing valve element for lowering the aforementioned load is disposed in a second parallel bore in the form of a blind bore. It ends together with the first bore at a flat face end of the common housing. On this face end, the electromagnetic drives are disposed directly side by side, as a result of which the drives can also be mechanically triggerable by simple means. Seated in a third bore is a check valve, which prevents a return flow of the pressure fluid from a consumer connection into the proportional distributing valve element for lifting.

To allow a large volumetric flow to pass through, some of the connections are embodied double.

BRIEF DESCRIPTION OF THE DRAWINGS

Further details of the invention will apparent from the ensuing description of three embodiments shown in simplified form.

DESCRIPTION OF THE PREFERRED EMBODIMENTS

Figure 1:
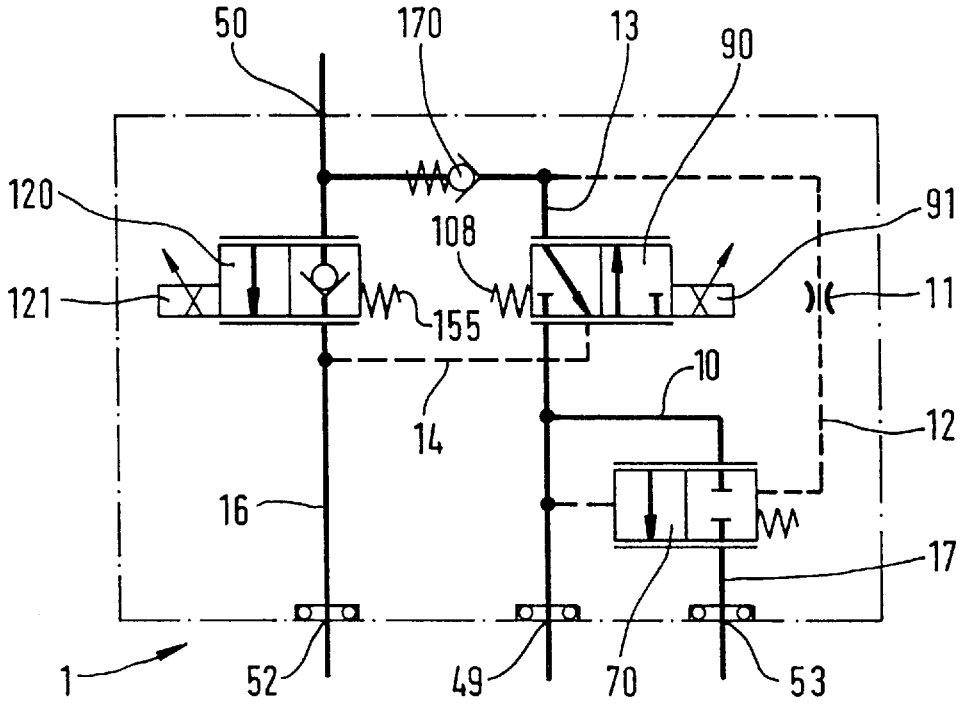
FIG. 1: a hydraulic circuit diagram of a control device for an OC hydraulic system, with two electromagnetically actuated proportional distributing valve elements, one pump connection, and one check valve, that is not run-on loadable.

The hydraulic circuit diagram shown in FIG. 1 illustrates a basic design of a hydraulic control (1) for an OC hydraulic system with two electromagnetically actuatable proportional distributing valve elements (90) and (120), a pressure balance (70), and a check valve (170). This control device (1), as well as those from FIGS. 5 and 9, each serve to trigger a single-acting hydraulic cylinder (7)—see FIG. 3—which is part of a self-propelled production machine, for example.

Both proportional distributing valve elements (90) and (120) are throttling distributing valves, whose longitudinal slides can assume arbitrary intermediate positions without graduations in addition to the two terminal positions. Each have a proportional magnet (91, 121) on one end and a restoring spring (108, 155) on the other. The first proportional distributing valve element (90) is a 3/2-way valve, and the second (120) is a 2/2-way valve. The flow of pressure fluid, coming from a pump connection (49), flows through the 3/2-way valve (90), via a separate check valve (170) to reach a consumer connection (50). It directs the flow of pressure fluid from a constant pump (5)—see FIG. 2 —to the consumer, which is a single-acting hydraulic cylinder (7) for lifting a load. The proportional distributing valve element (90) will therefore be called a lifting module hereinafter. The 2/2-way valve (120) controls the flow of pressure fluid, flowing from the single-acting hydraulic cylinder (7) under load via the consumer connection (50) to the tank via the return line (16). The second proportional distributing valve element (120) will accordingly be called the lowering module.

Between the pump connection (49) and the lifting module (90), the pressure balance (70) is disposed in a shunt branch (10), which is opened during neutral circulation and carries the unneeded flow of pressure fluid virtually unthrottled into a second return line (17). The return line (17) ends in a return connection (53). Connected to the pressure balance (70), besides a regulating spring (88), is a load indicator line (12) with a throttle valve (11) that branches off from the connecting line (13).

With the aid of a transverse return line (14), the load indicator line (12) communicates with the return line (16) via the 3/2-way valve (90) when the valve is not actuated.

For lifting a load, the proportional magnet (91) of the lifting module (90) is supplied with electric current. The transverse return line (14) is blocked, and pressure fluid is carried via the lifting module (90), the connecting line (13) and the check valve (70) to the consumer connection (50). Via the load indicator line (12), the pressure balance (70) is acted upon on its spring-loaded side, as a result of which the pumping flow is throttled to the load pressure prevailing at the consumer connection (50).

For lowering a load, with a proportional magnet (91), to which as a rule electric current is not supplied, the proportional magnet (121) of the lowering module (120) is activated. The pressure fluid flows from the consumer connection (50) to the return connection (52) via the lowering module (120) and the return line (16).

Figure 2:
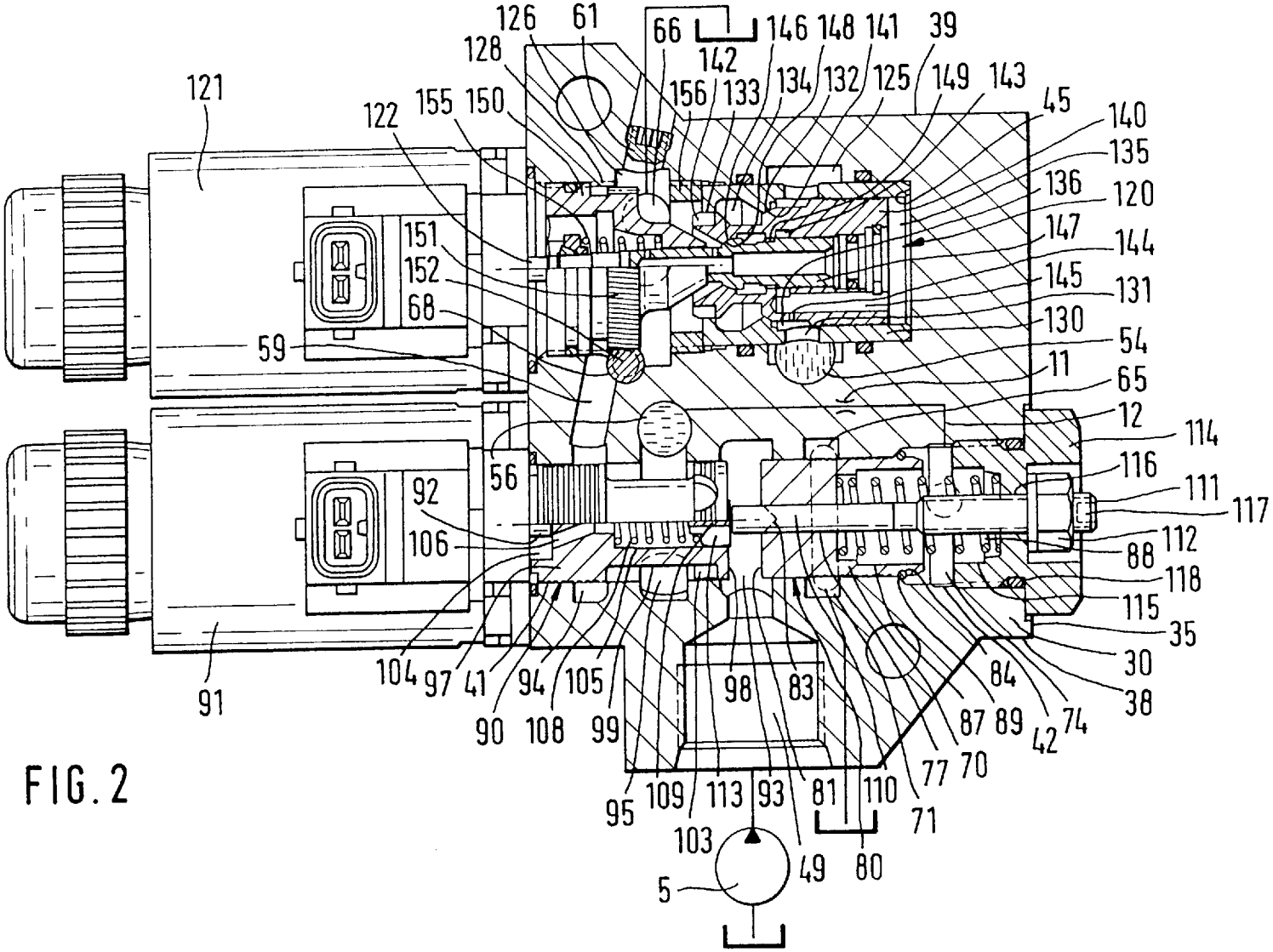
FIG. 2: section through a control device of FIG. 1.
Figure 4:
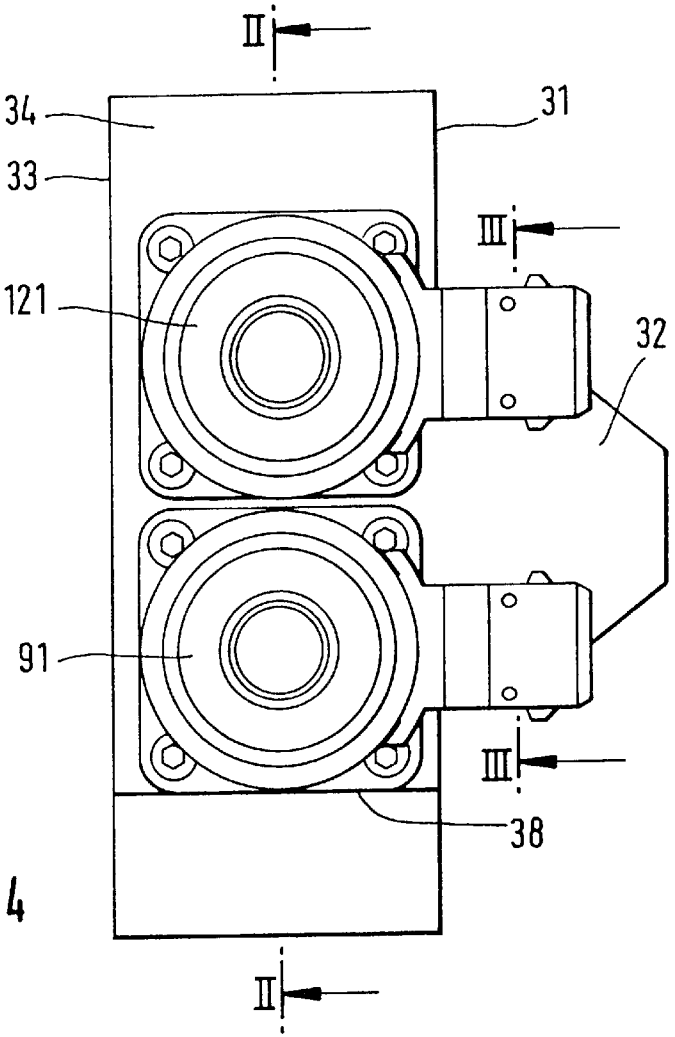
FIG. 4: side view of the control device of FIGS. 2 and 3.

In FIG. 2, the control device (1) realized is shown in section. It has a substantially parallelepiped housing (30) with two approximately square flat faces as its top and bottom sides (31) and (33); see FIG. 4. Discharging into the precision-machined underside (31) are a return conduit (65) and a return bore (66); see FIG. 2. The top and underside (31) and (33) also have two fastening bores (69, 69')—see FIG. 6—which pass through the housing (30) perpendicular to the sectional plane. On its top side (31), the housing has a housing expansion (32)—see FIG. 4—approximately in the middle.

The side faces (34, 35, 38, 39) oriented at right angles to the sectional face each have a rectangular outline. The front (34) and back sides (35) are two flat, T-shaped, precision-machined faces. The two proportional magnets (91) and (121) are flanged to the front side (34). Seated opposite the first proportional magnet (91) in the back side (35) is a closure screw (114); see FIG. 2. The consumer connection (50) is located obliquely above it; see FIG. 3.

Figure 6:
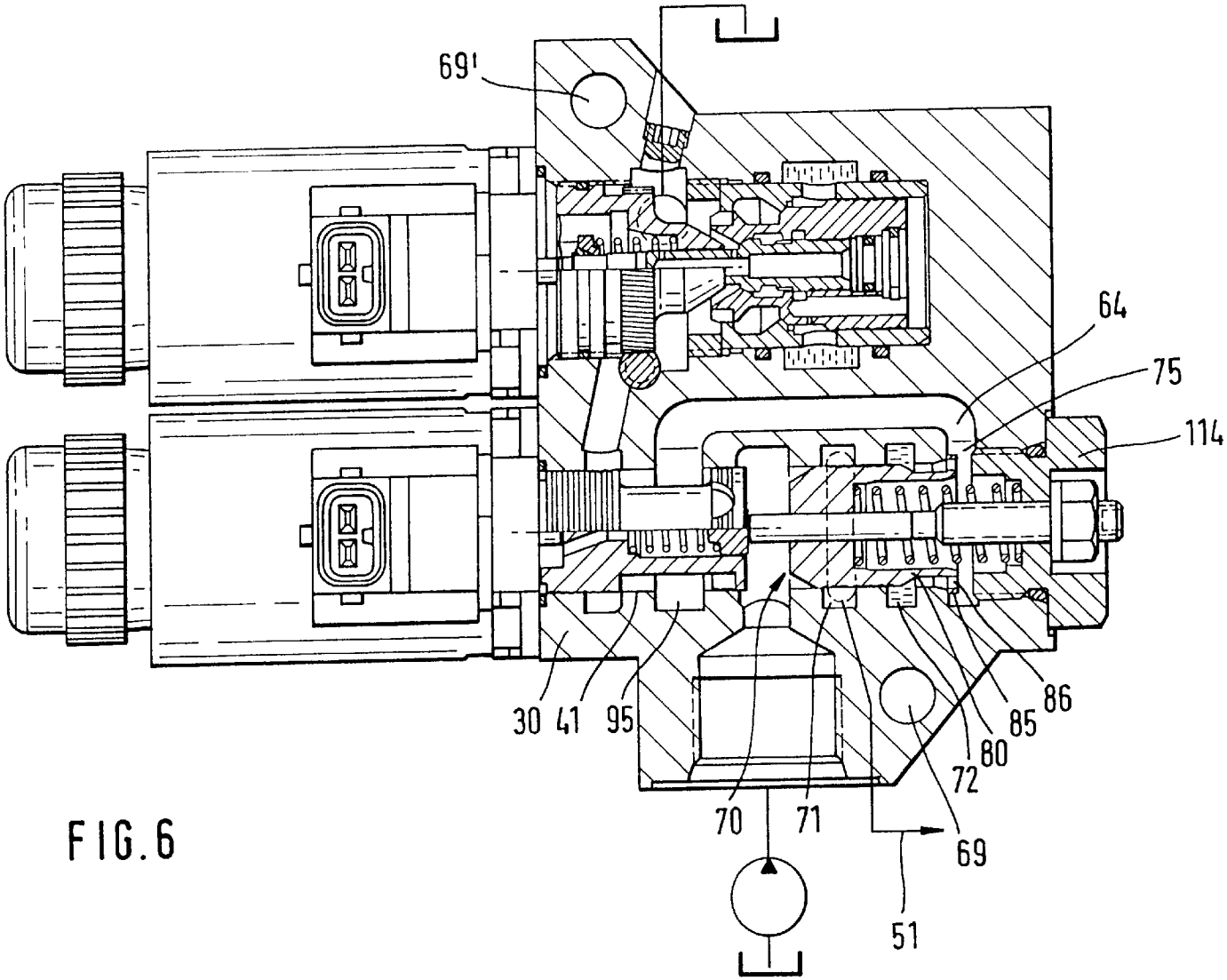
FIG. 6: section through a control device of FIG. 5.

The other two side faces (38, 39) have bulges that are formed around the fastening bores (69, 69'); see FIG. 6. The side face located at the bottom in FIG. 2 also has a stub for receiving the pump connection (49).

The pump connection (49) with a female thread merges in the housing (30) with an annular inflow conduit (93). The annular conduit (93) penetrates a cylindrical through bore (41), which extends from the front side (34) to the back side (35). The longitudinal slide (97) of the lifting module (90) is seated in the left-hand region of the through bore (41). There, two further conduits (94, 95) meet the through bore (41). The left-hand conduit (94) is an annular return conduit, which communicates with a transverse return bore (59) leading to the lowering module (120). Located on the right of this annular return conduit (94) is the annular connecting conduit (95), from which the connection conduit (56) branches off approximately at a tangent out of the sectional plane.

The longitudinal slide (97) of the lifting module (90) either connects the annular connecting conduit (95) with the annular return conduit (94)—in the unactuated state with zero coverage—or connects the annular connecting conduit (95) with the annular inflow conduit (93)—in the actuated state. To that end, the cylindrical outer contour of the longitudinal slide (97) has an annular groove (99). The annular groove merges in the region of its right-hand shaft collar with precision-control notches (103), which in conjunction with the pressure balance (70) have the function of a measuring throttle. The opening cross sections of the precision-control notches (103) decrease in the direction of the annular inflow conduit (93), but without reaching it—while the proportional magnet (91) lacks electric current. The precision-control notches (103) are round notches here, as an example.

A shoulder is located on the left edge of the outer contour of the longitudinal slide (97), in the region of the sealing ring between the proportional magnet (91) and the housing (30). Below this shoulder, the longitudinal slide (97) has a cylindrical indentation (104), on the bottom of which stands the armature tappet (92) of the proportional magnet (91). A plurality of short-circuit grooves are located in the outer contour between the shoulder and the annular groove (99).

From its right face end (98), the longitudinal slide (97) is drilled open in stepped fashion. The right-hand region of the stepped bore (105) serves to guide the restoring spring (108). The left-hand region has a smaller diameter and connects the stepped bore (105) with the indentation (104), via an obliquely extending compensation bore (106). The transition from the right-hand to the left-hand region of the stepped bore (105) is formed by a flat housing collar on which the restoring spring (108) is braced.

The other end of the restoring spring (108) rests on a stepped spring plate (109). The spring plate (109) is star-shaped in cross section—perpendicular to the imaginary center line of the through bore—to allow the pressure fluid to pass the longitudinal slide (97) unthrottled for the sake of pressure equalization. To that end, by way of example, it has a plurality of notches (113) distributed over its circumference. The cross section may also have a circular area, in which at least one relief bore is disposed. The spring plate (109) is seated on a rod (110), whose center line coincides with that of the through bore (41). The spring plate (109) is either a part of the rod (110) or else is seated, centered centrally, on it, for instance with the aid of a transverse press fit. The rod (110) protrudes into the cup-shaped pressure balance piston (80) disposed on the right next to the longitudinal slide (97), and there meets a threaded pin (111). The rod (110) is guided, sliding tightly, in a bore (77) in the face end (81) of the pressure balance piston (80). Since the spring plate (109) which is stationary in the longitudinal direction is supported together with the rod (110) in the two longitudinally movable valve parts (97) and (80), the outer envelope contour of the spring plate (109) is crowned. In this way, if the restoring spring (108) is tilted, among other possible situations, mutual canting between the longitudinal slide (97) and the spring plate (109) is averted.

The threaded pin (111) extends in the extension of the rod (110) and ends in the closure screw (114). To enable adjusting the threaded pin (111) in the longitudinal direction, the closure screw (114) has a female thread (116) in which this pin is seated when screwed in. To keep the structural length of the control device (1) short, the head of the closure screw (114) has a cylindrical indentation that serves as a socket for a check nut (112). The threaded pin (111) has a hexagonal socket (117) on its outer, free end by which it is adjusted and checked.

The through bore (41) merges on its right-hand end with a closure screw bore (42). The closure screw (114) is secured in the female thread of the bore (42). A sealing ring (110) seated in the region between the head and the thread seals off the closure screw bore (42) from the outside.

The cup-shaped pressure balance piston (80) is seated, sliding tightly, in the through bore (41) between the closure screw (114) and the longitudinal slide (97). This piston has a cylindrical outer contour, which has a half-round shoulder (84) on its right end, in which cut a spring ring (89) is inserted. The spring ring (89)—for instance when the control device is not experiencing a flow through it—rests on an inner housing collar, acting as a stop, that is formed between the through bore (41) and the larger-diameter closure screw bore (42). A right-hand stop for the pressure balance piston (80) is formed by the adjusting screw (114). Located on the left-hand edge of the outer contour of the pressure balance piston (80) are a plurality of precision-control notches (83), distributed over the circumference and machined into the pressure balance piston (80) from the left-hand face end.

The pressure balance piston (80) is chamferred behind the half-round shoulder (84). In the region in front of the spring ring (89) it has a series of short-circuit grooves.

A guide bore (87) for receiving the regulating spring (88) is machined into the pressure balance piston (80) from its right-hand face end. The guide bore (87) is narrowed at its bottom, in order to fix the regulating spring (88) radially. A bore (115) with a comparable contour is also located in the left-hand face end of the adjusting screw (114).

Two annular conduits (71) and (74) are located in the housing (30) in the region of the pressure balance (70). The annular return conduit (71) is located adjacent the annular inflow conduit (93). The annular return conduit (71) is for instance completely closed by the pressure balance piston (80) when a load is being lifted, and when the lifting flow is equal to the pumping flow, while it is opened during neutral circulation.

The load indicator conduit (74) is disposed between the annular return conduit (71) and the adjusting screw (114). It communicates with the connecting bore (56) via a load indicator line (12) that is parallel to the through bore (41). A throttle restriction (11) is disposed in the load indicator line (12).

The lowering module (120) has a blind bore (45), extending into the housing (30) from the front side (34), that is oriented parallel to the through bore (41) of the lifting module. The blind bore (45)—as in the case of the lifting module (90)—is closed in a pressure-fluid-tight manner on the left with the aid of the proportional magnet (121).

Seated in the right-hand region of the blind bore (45) is a valve bush (130), which receives two internested longitudinal slides (140) and (147). The valve bush (130) is axially secured in the blind bore (45), between one end of the bore and a screw ring (156) disposed on the left, with an internally located, continuous hexagonal socket. The left-hand region of the blind bore (45) is provided with a female thread for that purpose.

Figure 3:
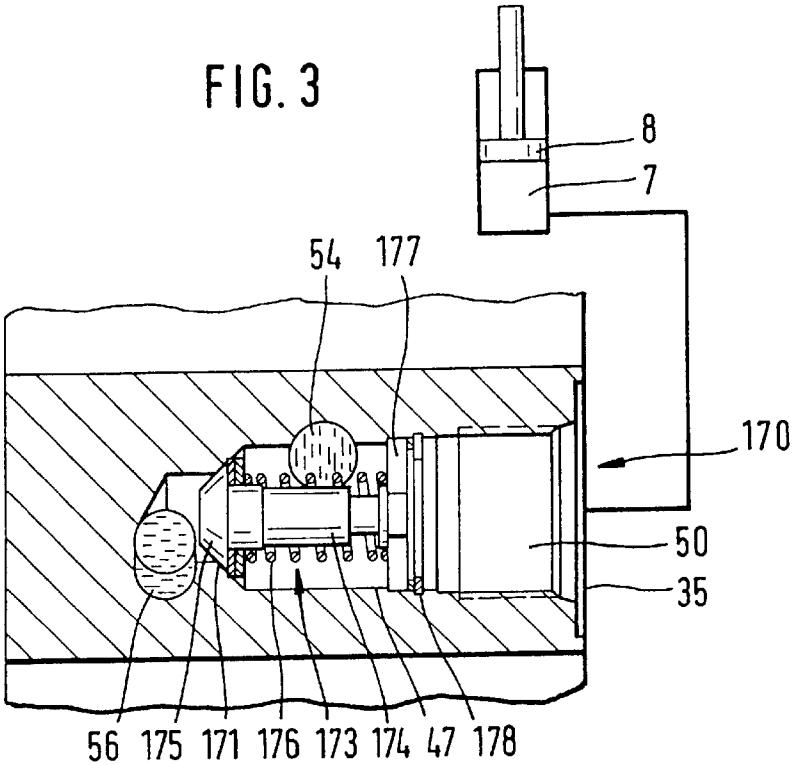
FIG. 3: section through the check valve of FIG. 1.

The valve bush (130) is surrounded by an annular consumer conduit (125), which communicates hydraulically with the consumer connection (50) shown in FIG. 3. To that end, a consumer bore (50) leads tangentially away from the annular consumer conduit (125) in the region between the lowering module (120) and the lifting module (90). The consumer bore (54) discharges into the check valve (170)—see FIG. 3—which is located at a higher level with respect to FIG. 2.

The check valve (170) has a valve bore (47) in the form of a blind bore, which is intersected at a tangent approximately halfway along the depth of the bore by the consumer bore (54). The valve bore (47) is embodied on its left-hand end as a conical jacketlike valve seat (171) and in the region of its right end as a consumer connection (50) with a female thread. Seated in the middle, cylindrical region is a spring-loaded check slide (173). This slide has a tubular shaft (174), on whose left end there is a frustoconical valve plate (175). A helical spring (176) that presses the check slide (173) against the valve seat (171) is disposed on the shaft. To that end, the helical spring (176) rests on the left, via one sealing washer and one shim, on the back side of the valve plate (175). On the right, it is braced against the star-shaped disk (177), which via at least one spacer disk rests on a securing ring (178) seated in the valve bore (47). The star-shaped disk (177) has a central bolt cantilevered toward the left, on which the tubular shaft (174) of the check slide (173) is guided.

The adjusting screw (150) is shown on the left in FIG. 2, next to the screw ring (156). The adjusting screw (150) is seated in the female thread (128). The female thread is interrupted, between the adjusting screw (150) and the screw ring (156), by an annular return conduit (126). The annular return conduit (126) communicates with the underside (33) of the housing (30) via the return bore (66) and with the annular return conduit (94) of the lifting module (90) via the transverse return bore (59). The transverse return bore (59) is closed in pressure-fluid-tight fashion, from the side face (39) limiting the lowering module (120), by means of a closure plug (61).

The lowering module (120), which primarily includes the adjusting screw (150) and the valve bush (130) with the two longitudinal slides (140) and (147), is known, with the exception of gearing (151) disposed on the adjusting screw (150), from German Patent Disclosure DE 41 40 604 A1. The structure of the lowering module (120) will therefore be described hereinafter solely in terms of its mode of operation.

The lowering module (120) is shown in FIG. 2 in the blocking position. The pressure fluid, which is present at the consumer connection (50) and thus via the consumer bore (54) at the annular consumer conduit (125), cannot flow into the annular return conduit (126). The longitudinal slide directly supported in the valve bush (130), which is the main control slide (140), has its main valve cone (141) in contact with the main valve seat (132) of the valve bush (130). Its main control notch (142)—disposed on its left-hand end—is located, concealed under the cylindrical seat (133), next to the annular chamber (134). In order to keep the main control slide (140) on the main valve seat (132), pressure fluid is present at low pressure on its right-hand face end in a pressure chamber (135). The pressure fluid reaches this chamber from the annular consumer conduit (125) via radial bores (131) in the valve bush (130) as well as in the main control slide via a throttle bore (144) and a longitudinal bore (145) adjoining it. The longitudinal bore (145), with its bore bottom, penetrates a control groove (143). The contact-pressure force is reduced by the contrary force exerted by the pressure prevailing in a consumer pressure chamber (136). The consumer pressure chamber (136) is located in the region of the outer contour of the main control slide (140) between the main valve cone (141) and short-circuit grooves. When the lowering module (120) is closed, both pressure chambers (135) and (136) are at the load pressure prevailing at the consumer connection (50).

The lowering module (120) opens when electric current is supplied to the proportional magnet (121). Its armature tappet (122) displaces the inner longitudinal slide, which is a pilot control slide (147), slightly toward the right. As a result, its pilot control notches (147) move underneath the control groove (143) of the main control slide (140). At the same time, its valve cone (148) located farther to the left lifts away from its corresponding valve seat (146) in the main control slide (140). The pressure chamber (135) now communicates with the return bore (66), via the longitudinal bore (145), the control groove (143), the pilot control notches (147), the valve seat (146), and the annular return conduit (126). Depending on the opening cross section of the pilot control notches (149), the pressure in the pressure chamber (135) drops. The pressure there adjusts in accordance with the ratio of the cross section of the throttle bore (146) and the opening cross section of the pilot control notches (149). If the pressure in the pressure chamber (135), with the pilot control slide (147) displaced correspondingly far to the right, drops far enough that the force exerted by the pressure fluid on the main control slide (140) toward the right in the region below the radial bores (131) predominates, then the main control slide (140) is likewise displaced to the right. The main valve cone (141) lifts away from the main valve seat (132), and the main control notches (142) enter the region of the annular chamber (134). The pressure fluid, coming from the consumer, flows between the valve bush (130) and the main control slide (140) in the direction of the annular return conduit (126). As a result of its opening motion, the main control slide (140) trails after the pilot control slide (147), and as a result the opening cross section of the pilot control notches (149) becomes smaller. A higher pressure can therefore build up in the pressure chamber (135) via the throttle bore (144). Consequently the opening motion of the main control slide (140) is braked, until a state of equilibrium is established.

If the armature tappet (122) moves to the left, then the pilot control slide (147) follows it, because of a restoring spring (155) integrated with the adjusting screw (150). The restoring spring (155) is braced on the pilot control slide (147) and on the adjusting screw (150). When the pilot control slide (147) moves, the pilot control notches (149) are closed. The pressure in the pressure chamber (135) rises. The main valve cone (141) presses against the main valve seat (132). The lowering module (120) blocks. The lowering module (120) thus functions in the manner of a follow-up control.

To enable adjusting the prestressing force of the restoring spring (155) with the control device mounted, the adjusting screw (150) has a helical gearing in the middle region of its outer contour, with which the gearing of an adjusting worm (152) meshes at least intermittently. The adjusting worm is seated to that end in an adjusting bore (168), which extends here from the back side (35) into the blind bore (45) and is tangent to both the transverse return bore (159) and the annular return conduit (126). With the aid of an adjusting spindle whose free end protrudes out of the housing (30), or a special tool that can be intermittently coupled to the adjusting worm (152) on the face end, the adjusting worm (152) can be set into rotation. Depending on the direction of rotation of the adjusting spindle or adjusting work (152), the adjusting screw (150) is screwed clockwise or counterclockwise in the female thread (128). The length of the adjustment range is large equivalent to the width of the gearing (151) of the adjusting screw (150).

When the load is lifted, and with electric current being supplied to the proportional magnet (91), pressure fluid flows via the pump connection (49), the annular inflow conduit (93), the longitudinal slide (97) and the connecting bore (56) into the valve bore (47), upstream of the check slide (173) of the check valve (170) shown in FIG. 3. The opening of the longitudinal slide (97) is effected via its precision-control notches (103). It forms a measuring throttle with respect to the pressure balance (70). The pressure fluid flows along the way to the check valve (170) via the load indicator line (12) and the load indicator conduit (74) to the back side of the pressure balance piston (80). Because of this connection layout of the pressure balance (70), a constant pressure drop always prevails both upstream and downstream of the precision-control notches (103), its magnitude being determined by the spring force of the regulating spring (88). As soon as the force on the front side of the valve plate (175), because of the pump pressure applied, exceeds the sum of the spring force on the one hand and the product of the load pressure and the surface area of the back side of the valve plate on the other, the check valve (170) opens, and the load begins to rise, or the piston (8) begins to move outward. The longitudinal slide (97) and the pressure balance piston (80) enable load-independent control of the volumetric flow to the consumer connection (50).

To terminate the lifting of the load, the proportional magnet (91) is turned off. The longitudinal slide (97) and the check slide (173) move to their closing positions, as shown in FIG. 2.

Figure 5:
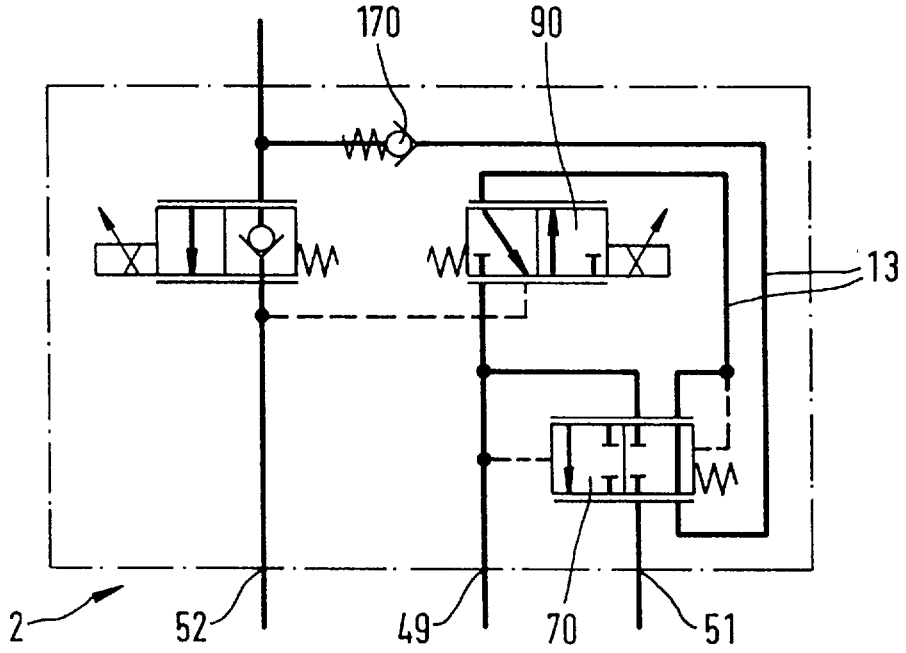
FIG. 5: hydraulic circuit diagram as in FIG. 1, but for a control device that is run-on loadable.

FIG. 5 shows the hydraulic circuit diagram for a control device (2) that is comparable to the control device (1). The pressure balance (70) in FIG. 5, however, is run-on loadable. Here the former return connection (53) becomes a run-on loadable second consumer connection (51). Moreover, the flow of pressure fluid carried from the 3/2-way valve (90) to the check valve (170) is guided controllable via the pressure balance piston (80) of the pressure balance (70).

The run-on loadability of the pressure balance (70) causes some changes in the control device (1). These changes are realized in a control device (2) shown in FIGS. 6–8.

Figure 8:
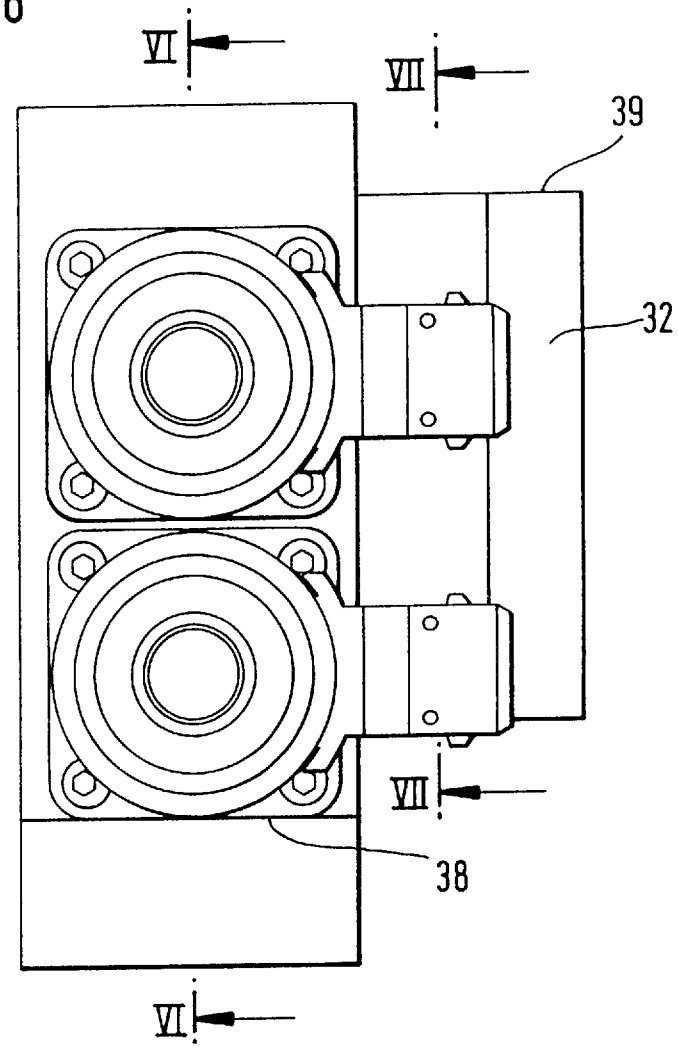
FIG. 8: side view of the control device of FIGS. 6 and 7.
Figure 7:
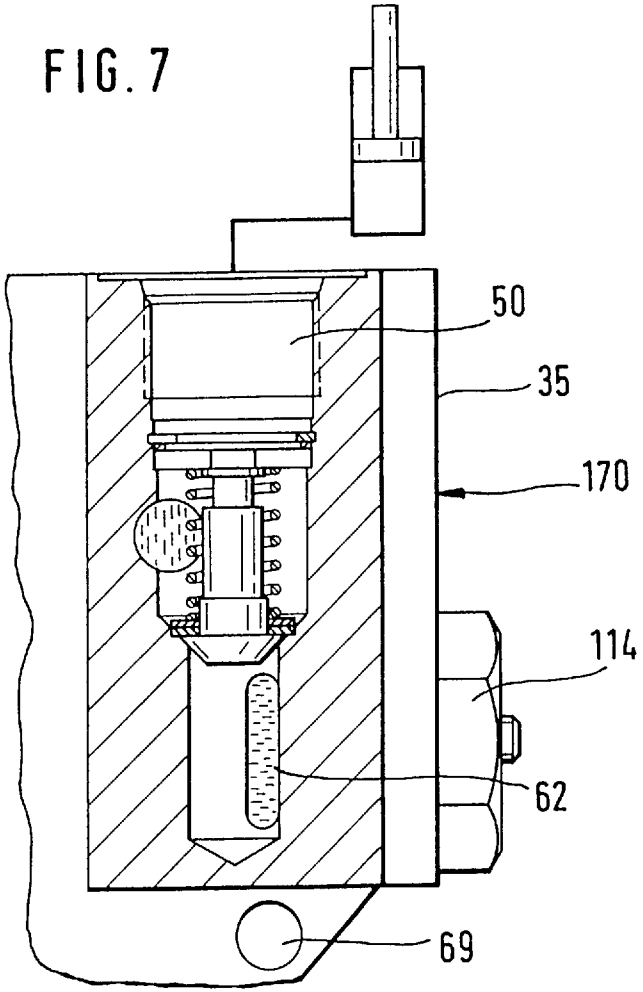
FIG. 7: section through the check valve of FIG. 5.

The location of the check valve (170) on the housing (30) of the control device (2) has changed; see FIGS. 7 and 8. Here, while the center line of the check valve (170) still extends parallel to the plane defined by the two center lines of the lifting module (90) and lowering module (120), but does not extend parallel to the center lines themselves but rather at right angles to them. Consequently the consumer connection (50) is located on the side face (39), which is now T-shaped.

In FIG. 6, a housing conduit (64) in the lifting module (90) leads from the connecting annular conduit (95) at least regionally parallel to the through bore (41) into an annular load indicator conduit (75) that is located between the closure screw (114) and the pressure balance piston (80).

In the region of the pressure balance (70), along with the annular return conduit (71), there are an annular consumer conduit (72) and an annular load indicator conduit (75). In this embodiment, additional consumers can be connected to the annular return conduit (71); see the consumer connection (51) in FIG. 5. The annular consumer conduit (72) leads via a shallow conduit (62) to the valve bore (47) of the check valve (170).

The outer contour of the pressure balance piston (80), which is altered compared with the first embodiment, is chamferred on its left edge. On its right edge, it has a waist, which toward the right face end merges with a stop face (85). The stop face (85), whose diameter exceeds the diameter of the pressure balance piston in the zone having the short-circuit grooves, has many apertures (86). Via the apertures (86), the pressure fluid—if the stop flange is contacting the left-hand wall of the annular load indicator conduit (75)—reaches the region of the waist and also, via a chamferred control edge adjoining it, reaches the shallow conduit (62) via the annular consumer conduit (72). To that end, the control edge is located approximately centrally in the annular consumer conduit (72). The chamfer on the left edge of the outer contour, which also forms a control edge, ends shortly upstream of the annular return conduit (71).

In the control device (2), load-pressure-independent control of the volumetric flow to the first consumer connection (50) is thus possible even if the run-on via the second pump connection (31) is pressure-loaded, since the pressure balance piston (80) has one additional control edge.

Figure 9:
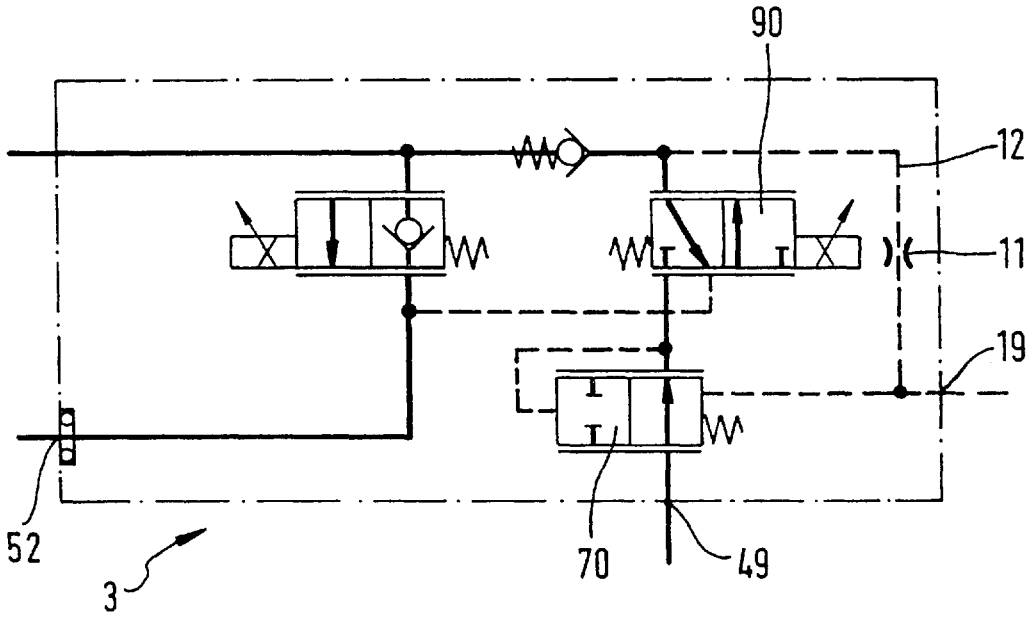
FIG. 9: hydraulic circuit diagram as in FIG. 1, but for an LS hydraulic system.
Figure 10:
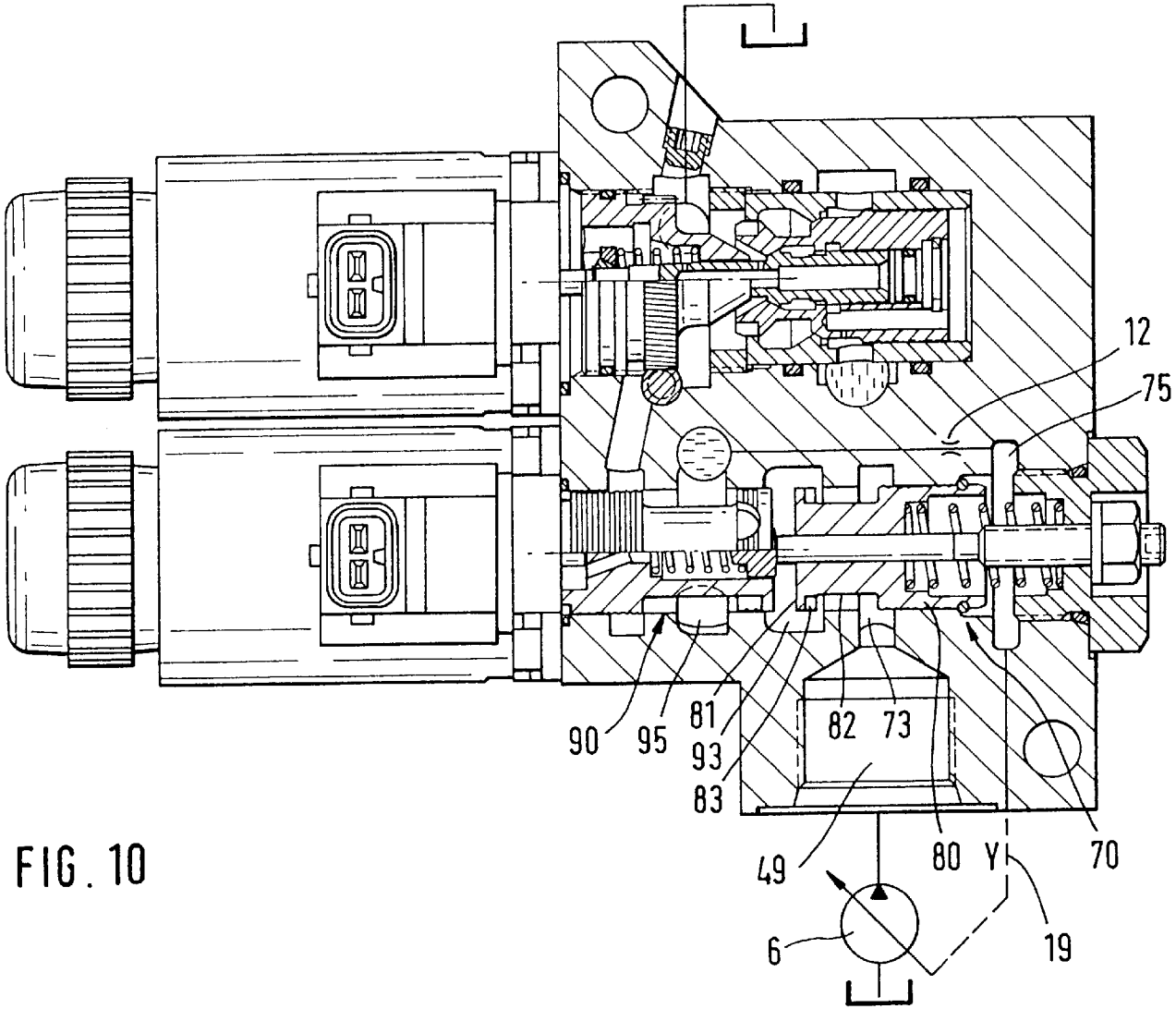
FIG. 10: section through a control device of FIG. 9.

A third embodiment of the hydraulic control can be found in FIGS. 9 and 10. The control device 3 shown here is suitable for an LS hydraulic system. To that end, in contrast to the two embodiments described above—see FIGS. 1 and 5—the pressure balance (70) is no longer seated in the shunt branch (10) but rather directly precedes the 3/2-way valve (90). The remaining circuit, including the load indicator system, is equivalent to the circuit of FIG. 1. In addition, for triggering the adjusting pump (6)—see FIG. 10 —that supplies the control device (3), a control line (19) branches off from the load indicator line (12) between the throttle restriction (11) and the pressure balance (70), and thus the regulating pressure drop of the LS hydraulic system prevails between the pump connection (49) and the control line (19).

FIG. 10 shows the third control device (3) in section. It differs structurally from the control device (1) in the region of the lifting module (90) and the pressure balance (70).

The pump connection (49) leads to an intermediate annular conduit (73), which passes through the through bore (41) in the middle region of the pressure balance piston (80). A control groove (80) disposed in the outer contour begins at its right-hand wall in the middle of the intermediate annular conduit (73)—at the position shown for the pressure balance piston in FIG. 10. The control groove (82) extends leftward to the inside of the annular inflow conduit (93). There, the control groove (82) merges with precision-control notches (83). The precision-control notches (83) end upstream of the face end (81) of the pressure balance piston (80).

When the lifting module (90) opens, pressure fluid under standby pressure coming from the adjusting pump (6) flows into the annular connecting conduit (95) and from there via the load indicator line (12), the annular load indicator conduit (75) and the control line (19) to the pump controller. The pump pressure rises in accordance with the load applied. As soon as pressure fluid flows to the consumer, the pressure drop at the longitudinal slide (97) and the opening cross section of the precision-control notches (103) determines the volumetric flow. The pressure balance (70) keeps the pressure drop constant at all times. This is also true in the event that a plurality of consumers are actuated in parallel.

We claim:

1. A hydraulic circuit in a monoblock structure for lifting and lowering a load, comprising at least two electromagnetically actuatable proportional distributing valve elements; a check valve; a pressure balance for load-independent lifting of the load as an input element; a housing accommodating at least some of said elements and having at least one pump connection, at least one consumer connection, and at least one return connection, said proportional distributing valve elements being disposed parallel to one another; electromagnetic drives seated side-by-side on a same side and at a same height, said pressure balance having a piston which is disposed coaxially next to a longitudinal slide of a first one of said proportional distributing valve elements in a bore that guides and supports both said valve elements, said longitudinal slide of said first proportional distributing valve elements being spring-loaded; and at least one component for adjusting a prestressing and bracing of a spring on said housing of a control penetrating said piston of said pressure balance.

2. A hydraulic circuit as defined in claim 1, wherein said at least one component is supported and guided in a bore of said longitudinal slide and a bore of said piston of said pressure balance.

3. A hydraulic circuit as defined in claim 1, wherein said component has a cylindrical, rod-shaped portion which is guided in said bore of said piston of said pressure balance, and a disk-shaped portion which is guided in said bore of said longitudinal slide.

4. A hydraulic circuit as defined in claim 3, wherein said spring arrests on said disk-shaped portion, said disk-shaped portion having a crowned outer contour in a region of contact with said bore of said longitudinal slide, and an outer contour formed as a zone of an ellipsoid whose rotary axis is located on an imaginary center line of said at least one component.

5. A hydraulic circuit as defined in claim 3, wherein said disk shaped portion is provided with formations selected from the groups consisting of apertures and recesses in a cross-section perpendicular to a rotationally symmetrical center line of an outer contour of said disk-shaped portion.

6. A hydraulic circuit as defined in claim 5, wherein said recesses are formed as radially oriented notches disposed in said disk-shaped portion.

7. A hydraulic circuit as defined in claim 1, wherein said bore is a through bore and has a diameter which is constant at least in a region where said valve elements are supported and guided.

8. A hydraulic circuit as defined in claim 1 and further comprising a closure element which is disposed on an end of said bore next to said pressure balance, said closure element having a female thread; and a threaded pin screwed in said female thread as an adjustable stop for said at least one component.

9. A hydraulic circuit as defined in claim 1, wherein a second one of said proportional distributing valve elements and said pressure balance each have a separate connection hydraulically downstream.

10. A hydraulic circuit as defined in claim 1, wherein an inner longitudinal slide of a second one of said proportional distributing valve elements is loaded by spring braced in said housing so that said inner longitudinal slide of said second proportional distributing valve element in a blocking state rests on a valve seat in an outer longitudinal slide.

11. A hydraulic circuit as defined in claim 10, and further comprising an adjusting screw which is disposed in said housing and prestresses said spring.

12. A hydraulic circuit as defined in claim 11, wherein said housing in a region of said adjusting screw has an adjusting bore with a center line intersecting a center line of said inner and outer longitudinal slides in a skewed fashion, and a shorter distance between said center lines is equivalent to an axial spacing between said adjusting screw and an adjusting wheel insertable into said adjusting bore.

13. A hydraulic circuit as defined in claim 1, and further comprising a separate check valve via which said two proportional distributing valve elements are linked to one another, said separate check valve being formed so that in a lowering function it is switched as a shunt.

14. A hydraulic circuit as defined in claim 1, wherein said first proportional distributing valve element is a single-staged directly actuated valve, a second one of said proportional distributing valve elements being a valve with a preliminary stage which is an inner longitudinal slide, a main stage which is an outer longitudinal slide, and a main valve cone and main control notches which are connected in series into a work flow, are disposed on an outer contour of said outer longitudinal slide.

* * * * *